US006821150B2

(12) United States Patent
Hall et al.

(10) Patent No.: US 6,821,150 B2
(45) Date of Patent: Nov. 23, 2004

(54) CONNECTOR ASSEMBLY HAVING DIELECTRIC COVER

(75) Inventors: John Wesley Hall, Harrisburg, PA (US); John Mark Myer, Millersville, PA (US); Michael Frederick Laub, Harrisburg, PA (US); Hurley Chester Moll, Harrisburg, PA (US); Charles Randall Malstrom, Lebanon, PA (US); Sean P. McCarthy, Palmyra, PA (US); Dmitry V. Zhmurkin, Harrisburg, PA (US); Nathan Tracy, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 49 days.

(21) Appl. No.: 10/302,684

(22) Filed: Nov. 22, 2002

(65) Prior Publication Data

US 2004/0102094 A1 May 27, 2004

(51) Int. Cl.[7] ..... H01R 13/648; H01R 4/66

(52) U.S. Cl. ..... 439/608; 439/609; 439/108

(58) Field of Search ..... 439/608, 609, 439/108

(56) References Cited

U.S. PATENT DOCUMENTS

| | | | | | |
|---|---|---|---|---|---|
| 6,053,773 | A | * | 4/2000 | Wu | 439/609 |
| 6,120,318 | A | * | 9/2000 | Reed et al. | 439/490 |
| 6,447,311 | B1 | * | 9/2002 | Hu et al. | 439/108 |

FOREIGN PATENT DOCUMENTS

| | | | |
|---|---|---|---|
| EP | 1 071 170 A1 | 1/2001 | H01R/13/646 |
| WO | WO 02/29938 A1 | 4/2002 | H01R/13/646 |

* cited by examiner

*Primary Examiner*—Chandrika Prasad

(57) ABSTRACT

A connector assembly comprising a central contact, an inner ground shield surrounding at least a portion of the central contact, and a dielectric cover. The dielectric cover has an inner cavity that receives the central contact and the inner ground shield. The dielectric cover includes a dielectric member formed integral therewith. The dielectric member extends into the inner cavity and at least partially surrounds the central contact to partially electrically isolate and separate the central contact and the inner ground shield from one another within the dielectric cover.

19 Claims, 11 Drawing Sheets

CONNECTOR ASSEMBLY HAVING DIELECTRIC COVER

BACKGROUND OF THE INVENTION

The present invention relates to electrical connector assemblies. More particularly, certain embodiments of the present invention relate to connector assemblies that include receptacle housings having integrally formed dielectric covers, and having stamped contacts and inner shields.

In the past, connectors have been proposed for interconnecting coaxial cables. Generally, coaxial cables have a circular geometry formed with a central conductor (of one or more conductive wires) surrounded by a dielectric material. The dielectric material is surrounded by a cable braid (of one or more conductive wires) that serves as a ground, and the cable braid is surrounded by a cable jacket. In most coaxial cable applications, it is preferable to match the impedance between source and destination electrical components located at opposite ends of the coaxial cable. When sections of coaxial cable are interconnected by connector assemblies, it is equally preferable that the impedance remain matched through the interconnection.

Today, coaxial cables are widely used. Recently, demand has arisen for radio frequency (RF) coaxial cables in applications such as the automotive industry. The demand for RF coaxial cables in the automotive industry is due in part to the increased number of signals carried within automobiles, such as AM/FM radios, cellular phones, GPS, satellite radios, Blue Tooth™ compatible systems and the like.

Conventional coaxial connectors include diecast or screw machined outer shells, molded or screw machined dielectric housings and screw machined or drawn center contacts. The center contact is terminated to the center conductor of the coaxial cable. The center conductor is slid through an opening in the outer shell until seated. A ferrule is then slid into place and crimped thereby providing a ground path.

Some connector assemblies include matable plug and receptacle housings carrying separate dielectric subassemblies. The dielectric subassemblies include dielectric members, metal outer shields, and center contacts. The dielectric subassemblies receive and retain coaxial cable ends, and the outer shields have pins that pierce the jacket of the cable to electrically contact the cable braids while the center contacts engage the central conductors. The plug and receptacle housings include interior latches that catch and hold the dielectric subassemblies, and thus the coaxial cable ends, therein. When the plug and receptacle housings are mated, the dielectric subassemblies are engaged such that the outer shields are interconnected and the center contacts are interconnected with the dielectric members interconnected therebetween to form a dielectric layer between mated outer shields and mated center contacts.

However, some coaxial connector assemblies suffer from certain drawbacks. The interior latches allow the dielectric subassemblies to axially float forward and backward within the plug and receptacle housings. When the plug and receptacle housings are mated, the dielectric subassemblies have a limited longitudinal clearance in order that the mated dielectric subassemblies separate slightly from each other without being disconnected or interrupting the electrical connection. When such a separation occurs, the dielectric members are slightly separated such that air gaps develop between the connected center contacts and the connected outer shields. Because air has a different dielectric constant than that of the dielectric members and cable dielectric material, the impedance experienced by the electric signals changes at the point where the dielectric subassemblies interconnect. The change in impedance causes the electric signals to be reflected at the point of interconnection, which increases the power required to electrically connect the coaxial cables.

Additionally, typical connector assemblies include many separate components that are screw-machined and die-cast. These processes add additional costs to the assemblies themselves, and to the process of assembling the connector. Further, connector assemblies having circular cross-sectional geometries are difficult to manufacture, and often have tolerances that may produce variations in impedance.

Thus, a need exists for a more efficient and easier-to-assemble electrical connector.

BRIEF SUMMARY OF THE INVENTION

Embodiments of the present invention provide a connector assembly comprising a first housing configured to be mounted to a coaxial cable and a second housing configured to be mounted on a circuit board. The first and second housings mate with one another and at least one of the first and second housings comprises a central contact, a ground shield and a dielectric cover.

The ground shield surrounds at least a portion of the central contact. The dielectric cover holds the central contact and the ground shield. The dielectric cover comprises a contact cavity having an open front end and a closed rear wall. The rear wall comprises a dielectric member formed integral therewith and extending outwardly into the contact cavity to a position between the central contact and the ground shield. The central contact and the ground shield are electrically isolated and separated from one another within the dielectric cover by at least the dielectric member. The dielectric member may extend along at least one complete side of the central contact. The dielectric member of one of the first and second housings is configured to slide along a corresponding dielectric member of the other housing.

The ground shield may include bottom and side panels formed integrally with one another. The bottom panel is positioned below the central contact and the dielectric member is positioned above the central contact. Optionally, the ground shield includes top and side panels formed integrally with one another such that the top panel is positioned above the central contact and the dielectric member is positioned below the central contact.

Figure 1:
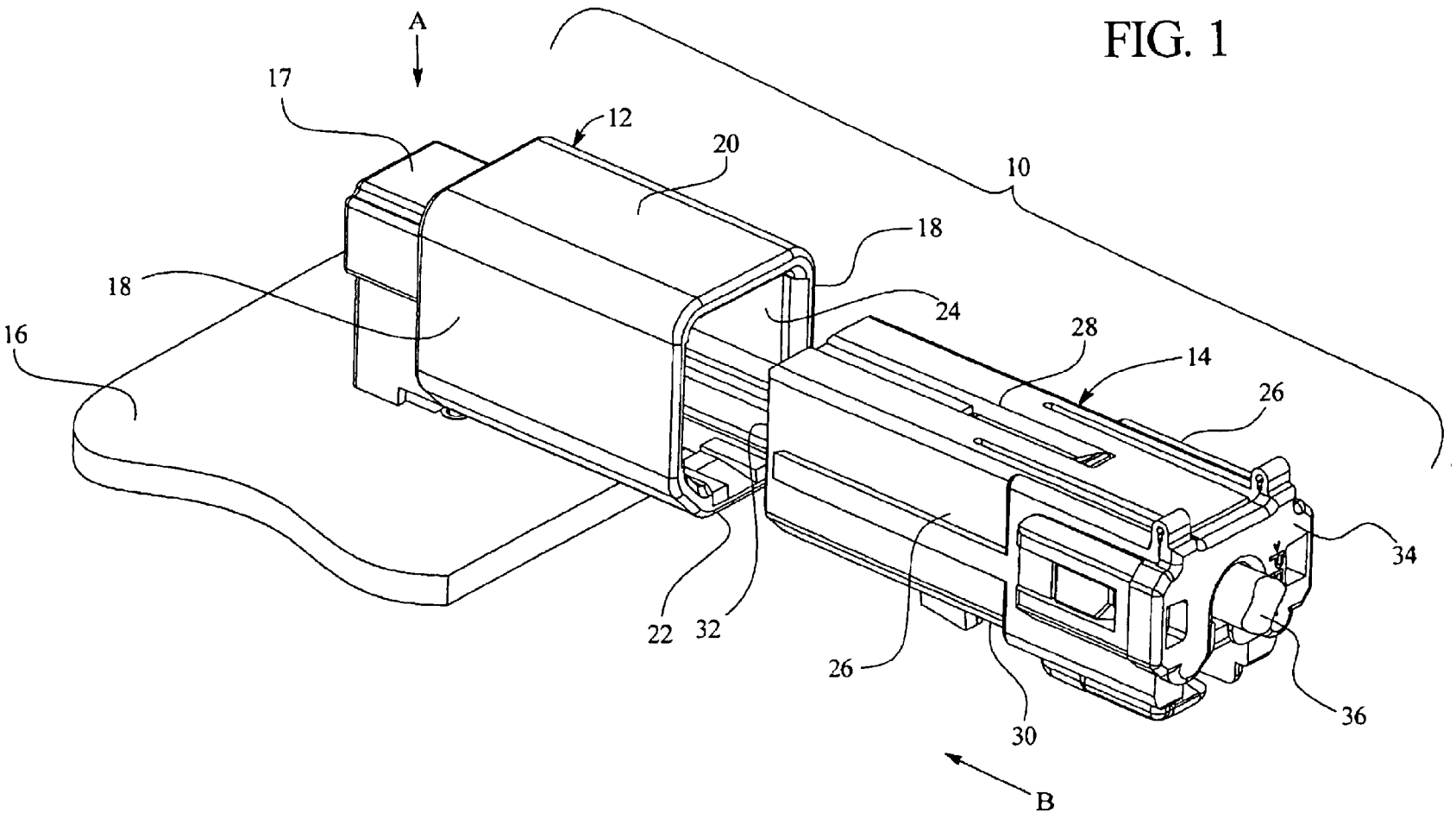
FIG. 1 illustrates an isometric view of an electrical connector assembly in a pre-mated position according to an embodiment of the present invention.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

Figure 2:
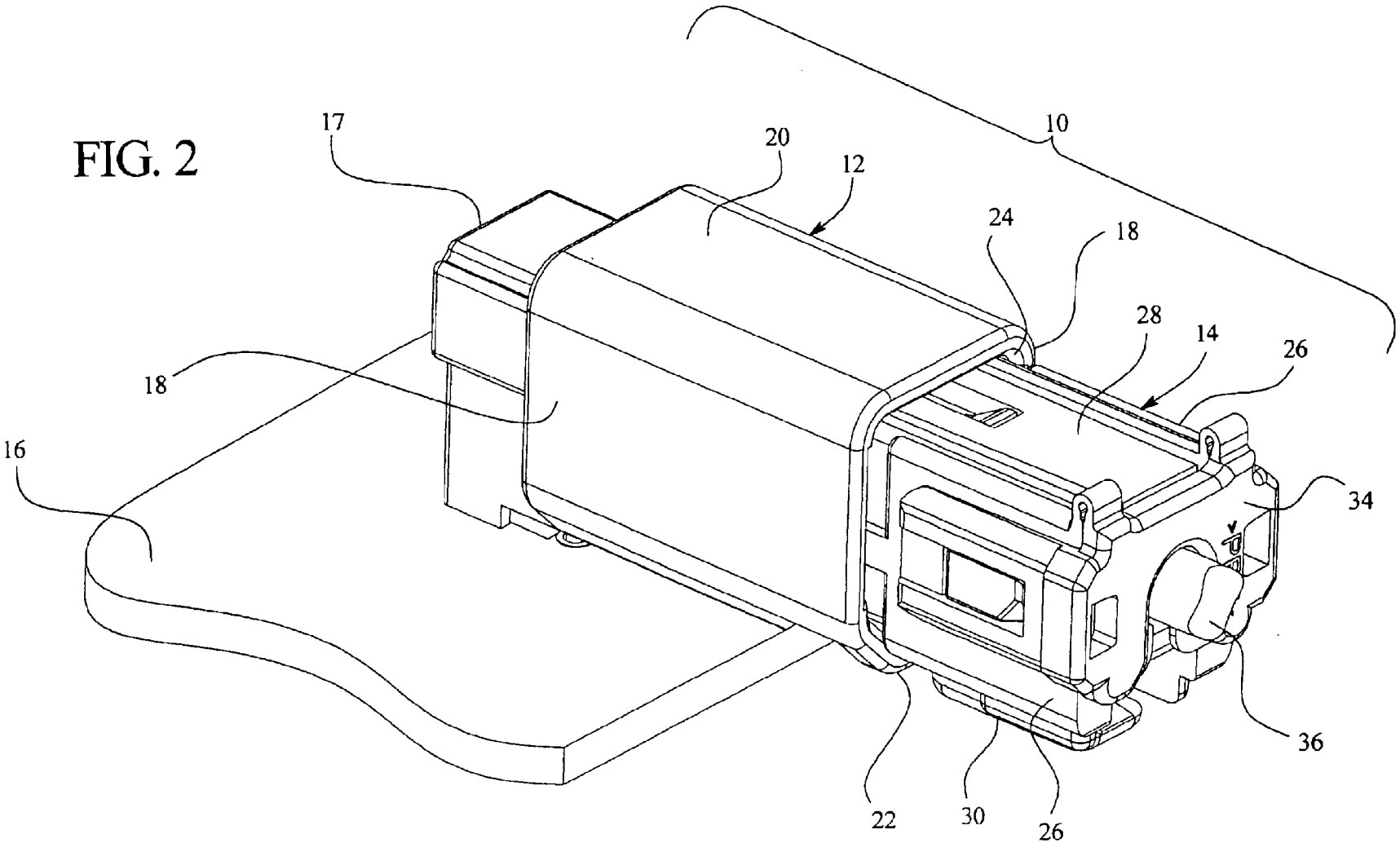
FIG. 2 illustrates an isometric view of a fully mated electrical connector assembly according to an embodiment of the present invention.

FIGS. 1 and 2 illustrate isometric views of a pre-mated and fully assembled electrical connector assembly 10. The connector assembly 10 includes a receptacle housing 12 and a plug housing 14. The receptacle housing 12 is configured to be mounted on a printed circuit board 16 in the direction of line A. The receptacle housing 12 includes a rear end 17 and lateral walls 18 integrally formed with a top wall 20 and a bottom wall 22. The lateral, top and bottom walls 18, 20 and 22, which define a plug reception cavity 24, are configured to slidably receive and retain the plug housing 14 within the plug reception cavity 24. The plug housing 14 includes lateral walls 26 formed integrally with top and bottom walls 28 and 30, a receptacle interface end 32 and a coaxial cable interface end 34. The cable interface end 34 receives an end of a coaxial cable 36 that is retained by the plug housing 14. The plug housing 14 is further described in U.S. application Ser. No. 10/191,136, entitled "Electrical Connector Assembly for Coaxial Cables," filed Jul. 9, 2002, which is incorporated by reference herein in its entirety.

Figure 11:
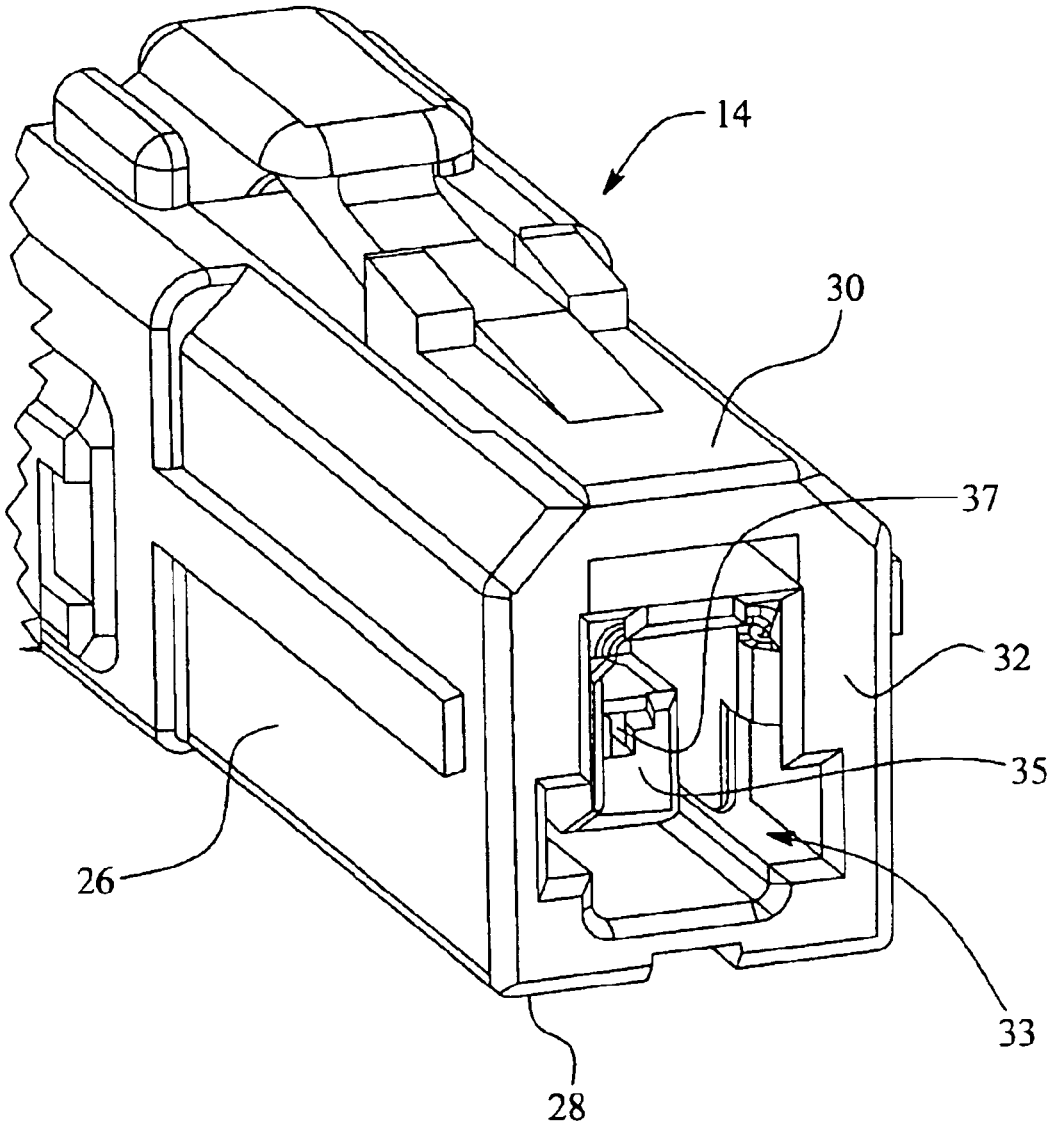
FIG. 11 illustrates an isometric view of a plug housing according to an embodiment of the present invention.

FIG. 11 illustrates an isometric view of the plug housing 14 according to an embodiment of the present invention. The interface end 32 of the plug housing 14 is configured to mate with the plug reception cavity 24 of the receptacle housing 12. An inner cavity 33 is formed within the interface end 32 and includes a dielectric member 35 protruding from an interior wall. The dielectric member 35 includes a contact channel 37 that is configured to receive a clip portion of a central contact (shown below). The plug housing 14 mates with the receptacle housing 12 so that the central contact of the receptacle housing 12 is mated with an inner contact of the plug housing 14. Additionally, a dielectric member of the receptacle housing 12 is positioned on one side of the central contact and the dielectric member 35 is positioned on the opposite side of the central contact when the plug housing 14 is mated into the receptacle housing 12.

During mating, the plug housing 14 is slid into the plug reception cavity 24 in a longitudinal direction denoted by line B until an electrical contact within the plug housing 14, which is electrically connected to the cable 36, is mated with an electrical contact (shown and discussed below) housed within the receptacle housing 12. The receptacle housing 12 is in turn electrically connected to the circuit board 16. As shown in FIGS. 1 and 2, the connector assembly 10 is a right angle connector. Optionally, the connector assembly 10 may be formed straight or at a different angle.

Figure 3:
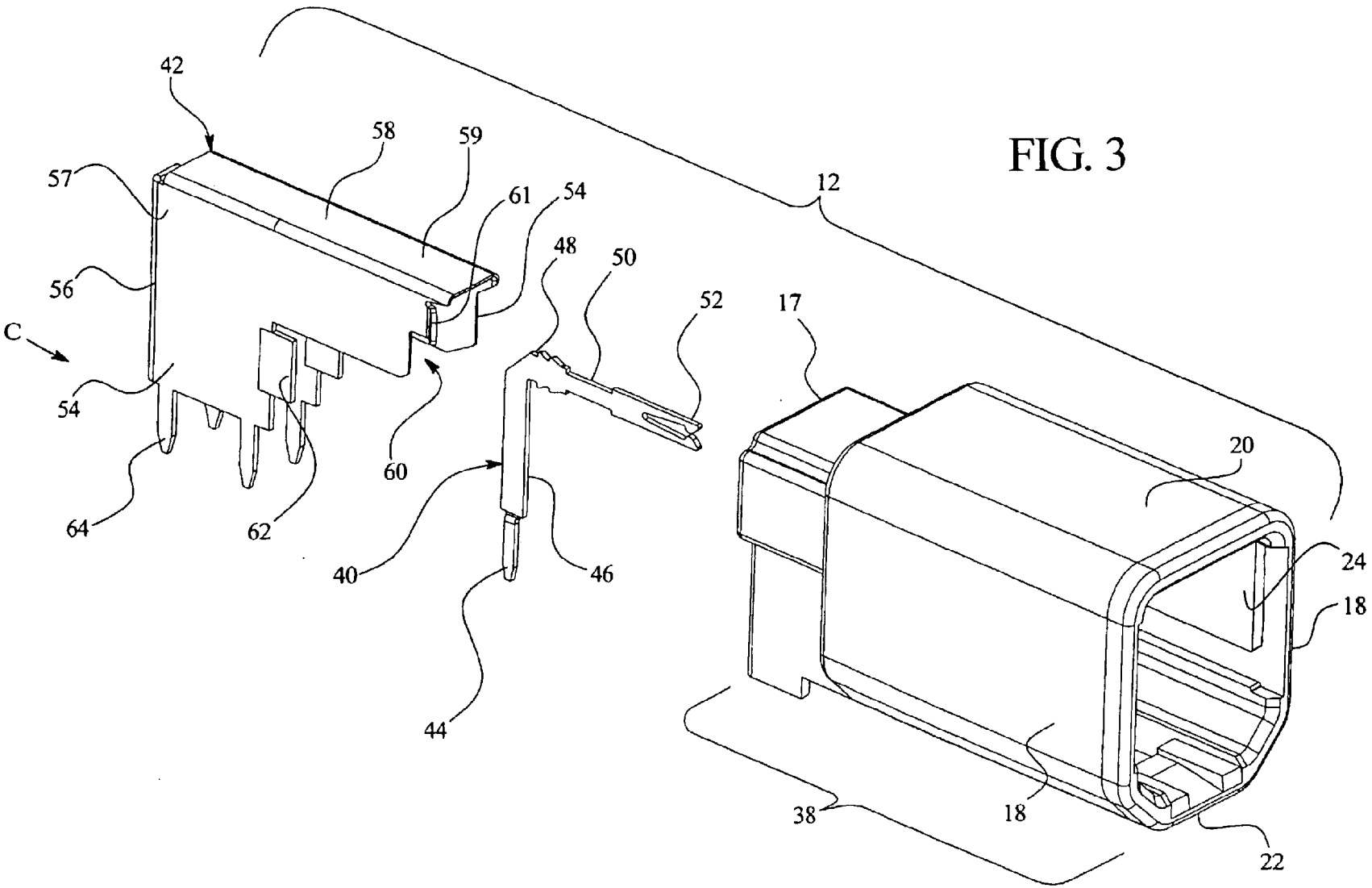
FIG. 3 illustrates an exploded isometric view of a receptacle housing according to an embodiment of the present invention.

FIG. 3 illustrates an exploded isometric view of the receptacle housing 12 according to an embodiment of the present invention. The receptacle housing 12 includes an integrally-formed, one-piece dielectric cover 38 that includes the side walls 18, top and bottom walls 20, 22, plug reception cavity 24 and the rear end 17. The receptacle housing 12 includes a central contact 40 and an inner shield 42, which partially surrounds and shields the central contact 40 within the plug reception cavity 24. The central contact 40 and the inner shield 42 are loaded into the dielectric cover 38 through an opening in the rear end 17. The inner shield 42 is electrically isolated from the central contact 40 by the dielectric cover 38.

The central contact 40 includes a post 44 formed integrally with an intermediate portion 46. The post 44 is configured to be received and retained within via or through-hole (not shown) formed in the circuit board 16. The intermediate portion 46 is joined with a right-angled transition portion 48, which is, in turn, joined with a clip portion 50. Optionally, the central contact 40 may be surface mounted to the circuit board 16. Alternatively, the central contact 40 may include a conductive pad, which electrically mates with a through-hole of the circuit board 16, instead of the post 44. The clip portion 50 includes a contact clip 52 that is configured to mate with a blade contact (not shown) of the plug housing 14. The central contact 40 is a signal contact that forms a transmission line in combination with the inner shield 42 and allows a signal to pass to and from the plug housing 14 through the receptacle housing 12 and into the circuit board 16. As mentioned above, the central contact 40 is covered and shielded by the inner shield 42, which is a ground member. That is, the inner shield 42 is configured to partially surround the central contact 40. However, while the inner shield 42 covers, or otherwise surrounds, the central contact 40, the inner shield is separated from the inner shield 42 by interior structures of the dielectric cover 38 (as discussed below with respect to FIGS. 4 and 5).

The inner shield 42 includes side panels 54 formed integrally with a back panel 56 and a top panel 58. The side panels 54 are L-shaped and, in conjunction with the back and top panels 56 and 58, define a central contact chamber 60. The inner shield 42 also includes a main cavity portion 59 and a passage portion 57. The main cavity portion 59 extends outwardly from the passage portion 57. At least one of the side panels 54 includes an outwardly projecting tab 62 that assists in interlocking the inner shield 42 into the dielectric cover 38. As shown below in FIG. 5, the projecting tabs 62 fold over a portion of rear cavity wall 72 of the receptacle housing 12. The projecting tabs 62 pass through slots formed in the rear cavity wall 72 and are then folded over a portion of the rear cavity wall 72. Alternatively, the projecting tab 62 may snapably or latchably engage a corresponding structure within the extended portion 67 (discussed below) of the dielectric housing 38 so that the inner shield 42 is securely retained within the dielectric housing 38. Referring again to FIG. 3, additionally, at least one of the side panels 54 may include an anti-stubbing tab 61 configured to engage or pre-align a corresponding structure of the plug housing 14, such as the inner shield 42, to ensure a secure connection between the inner shield 42 and the plug housing 14. While the inner shield 42 is shown as an L-shape, it may alternatively be formed in the shape of a "J" or "U."

Each side panel 54 also includes posts 64 integrally formed therewith. The posts 64 extend downwardly from the side panels 54 and are configured to be received and retained by vias or throughholes (not shown) formed within the circuit board 16. The inner shield 42 may include more or less posts 64 than those shown. Similar to the post 44 of the central contact 40, the posts 64 may be configured to be surface mounted or through-hole mounted to the circuit board 16. Optionally, the posts 64 may include conductive pads that electrically mate with corresponding structures on the circuit board 16. Alternatively, instead of posts 64, the side panels 54 may include conductive pads extending downwardly therefrom.

Figure 4:
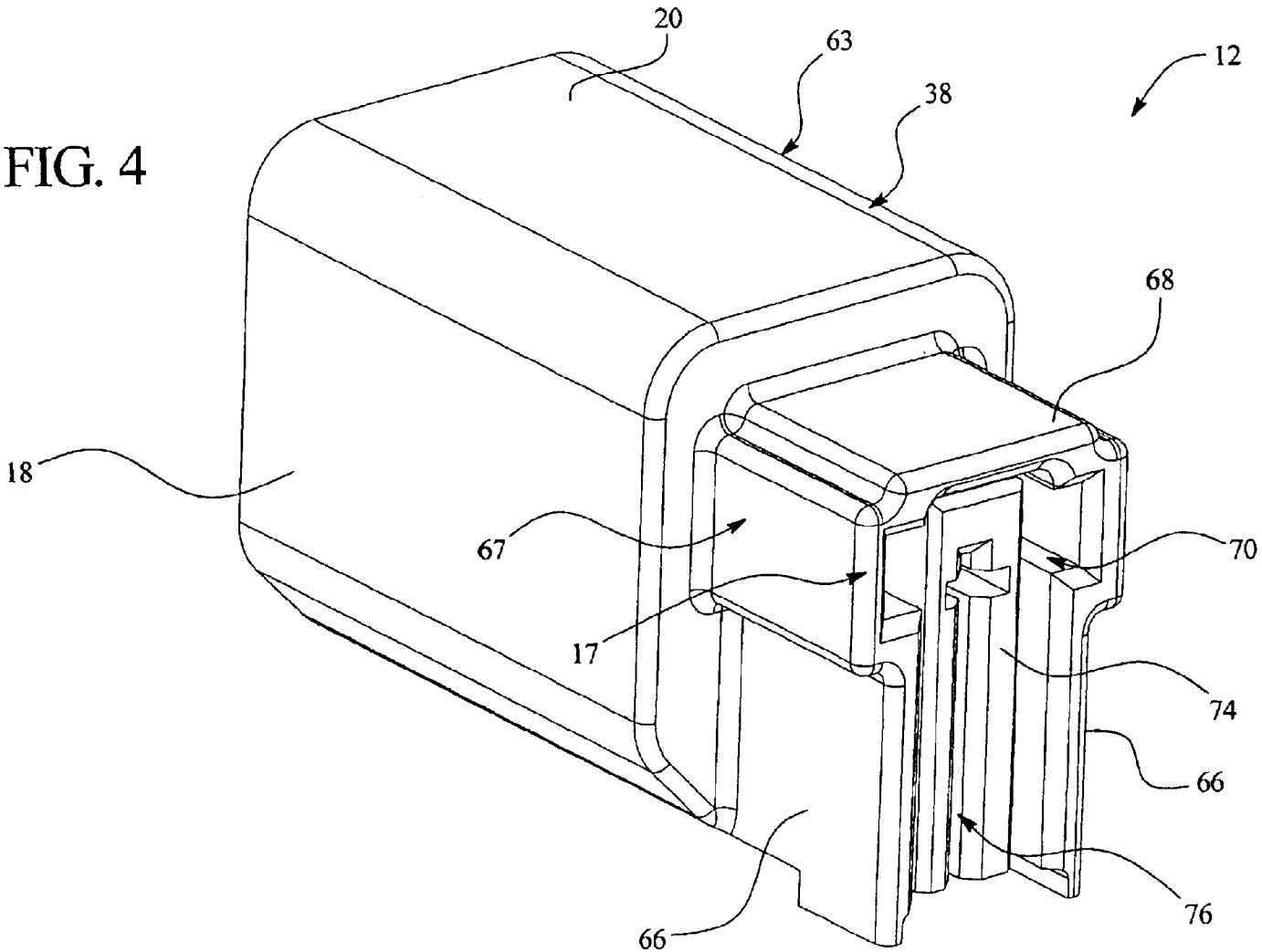
FIG. 4 illustrates an isometric rear view of a receptacle housing according to an embodiment of the present invention.

FIG. 4 illustrates an isometric rear view of the receptacle housing 12. The receptacle housing 12 includes a main body 63 and an extended portion 67 at the rear end 17. The extended portion 67 has side and top walls 66 and 68 that define a passage 70 that is configured to receive and retain the inner shield 42. The extended portion 67 also includes an interior rear surface 74 that has a channel 76 formed therethrough. The interior rear surface 74 may allow passage of the central contact 40 therethrough before the inner shield 42 is positioned over the interior rear surface 74 within the receptacle housing 12. Once the inner shield 42 is inserted into the receptacle housing 12, a rear wall of the inner shield 42 covers the interior rear surface 74 and the channel 76.

Figure 5:
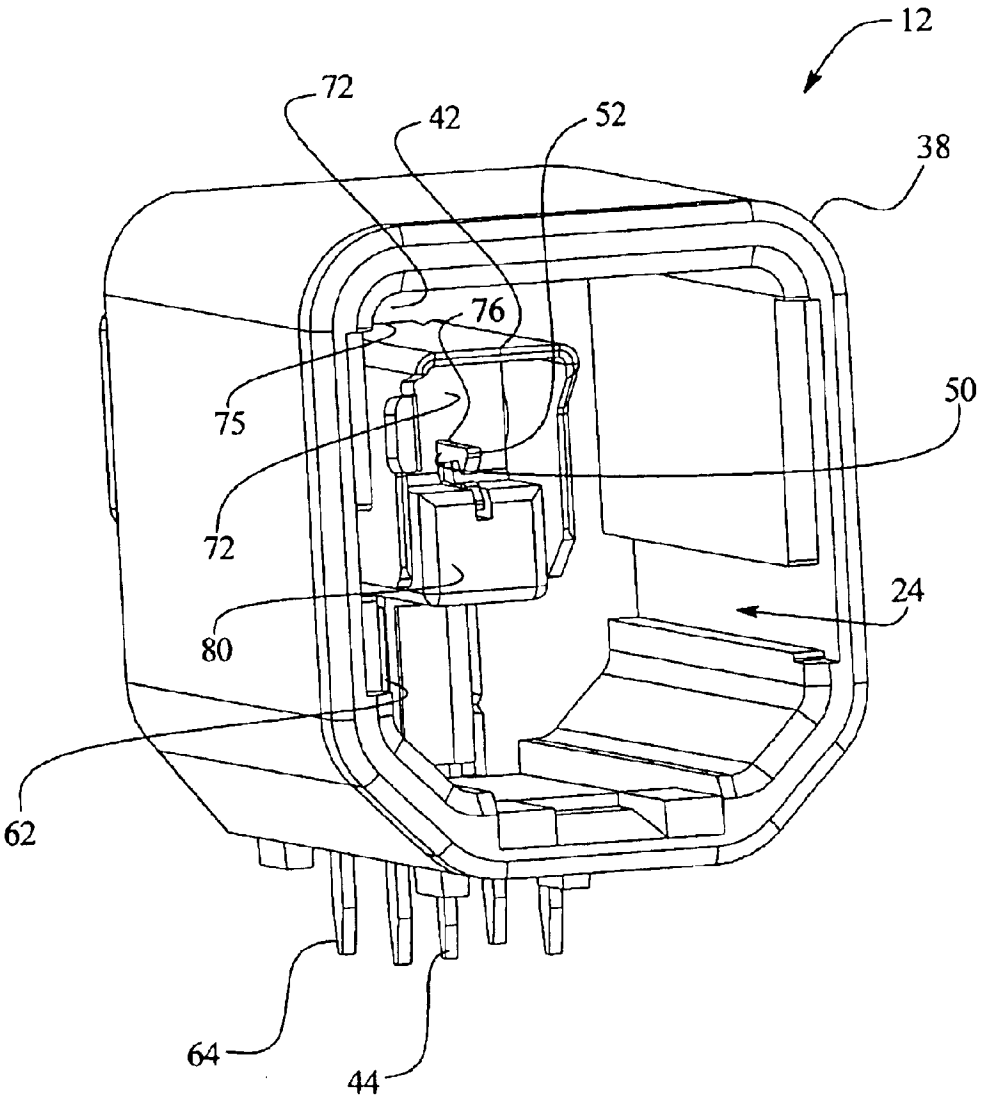
FIG. 5 illustrates an isometric front view of a receptacle housing according to an embodiment of the present invention.

FIG. 5 illustrates an isometric front view of the receptacle housing 12. An inner shield channel 75 is formed within a rear cavity wall 72 that allows at least a portion of the inner shield 42 to pass into the plug receptacle cavity 24. A contact channel 76 is formed within the cavity wall 72. A dielectric member 80 extends outwardly from the cavity wall 72 into the plug receptacle cavity 24. As shown in FIG. 5, the clip portion 50 of the central contact 40 is separated from the inner shield 42 by the cavity wall 72 and the dielectric member 80. Upon mating with the plug housing 14, a dielectric member of the plug housing 14 may be mated into the cavity defined by the top panel 58 of the inner shield 42 and the dielectric member 80. Upon mating, the dielectric member 80 may cover a bottom side of the clip portion 50 of the central contact 40 while the dielectric member of the plug housing 14 may cover the top side of the clip portion 50. The dielectric member 80 assists in supporting the clip portion 50 of the central contact 40. The contact clip 52 may extend outwardly from the contact channel 76. Alternatively, the contact clip 52 may not extend beyond the front surface of the dielectric member 80. In either case, the contact channel 76 and the contact clip 52 are configured to allow electrical mating between the central contact 40 and a corresponding contact (not shown) of the plug housing 14. Optionally, an outer ground shield (similar to outer shield 90, shown with respect to FIG. 6), may cover the receptacle housing 12.

Figure 6:
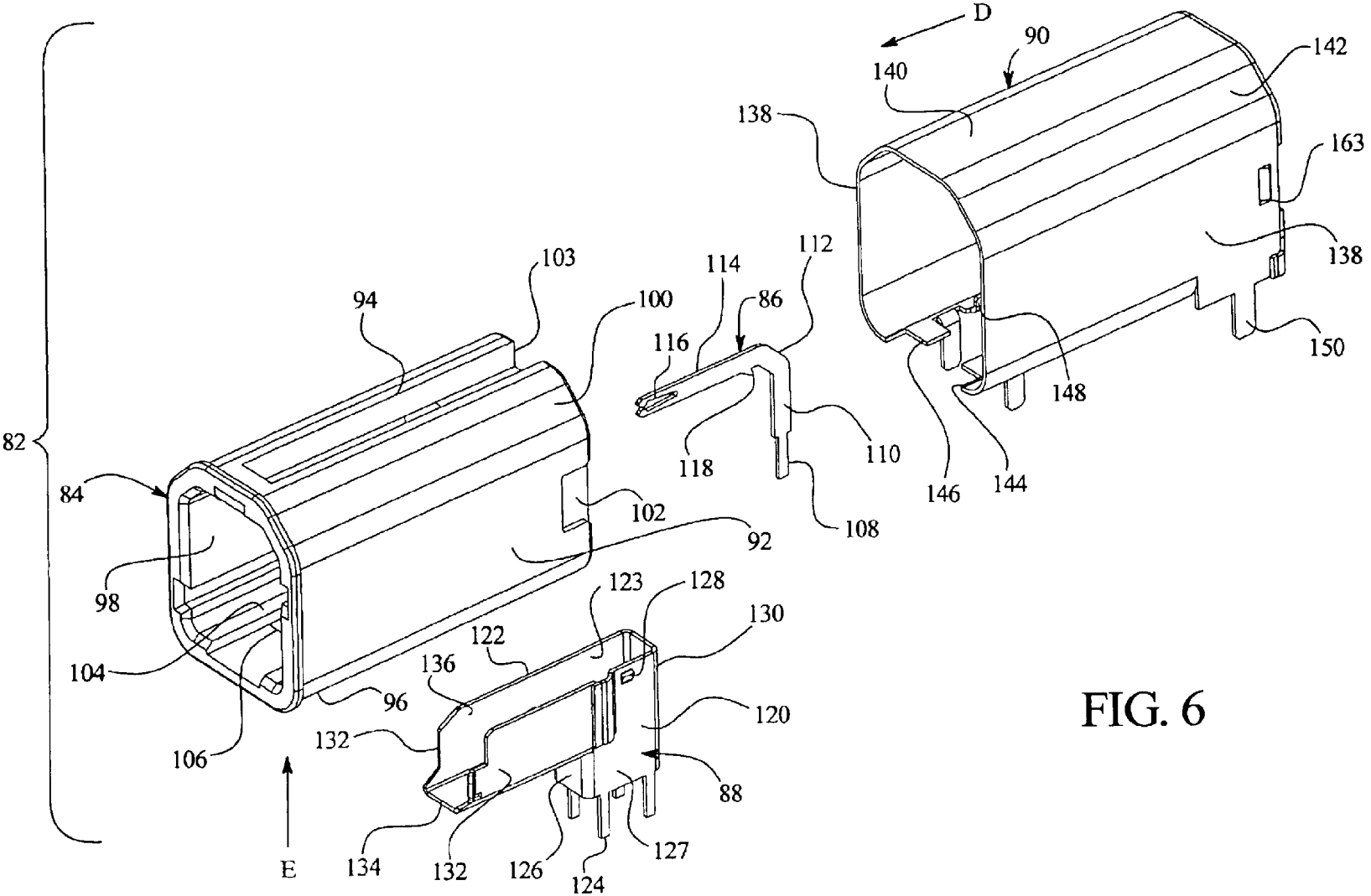
FIG. 6 illustrates an exploded isometric view of a receptacle housing according to an alternative embodiment of the present invention.

FIG. 6 illustrates an isometric exploded view of a receptacle housing 82 according to an alternative embodiment of the present invention. The receptacle housing 82 includes a one-piece, integrally formed dielectric cover 84, a central contact 86, an inner shield 88, and an outer shield 90. Alternatively, the receptacle housing 82 need not include the outer shield 90. The receptacle housing 82 is configured to mate with the plug housing 14.

The dielectric cover 84 includes side walls 92 integrally formed with a top wall 94 and a base 96. The base 96 and side and top walls 92 and 94 define a plug reception cavity 98. The top wall 94 is integrally connected to the side walls 92 through beveled edges 100. The side walls 92 include ramps 102 formed proximate a rear end 103 of the dielectric cover 84 that engage protrusions formed within the outer shield 90. The dielectric cover 84 is configured to allow the outer shield 90 to slidably and/or snapably engage the dielectric cover 84. The base 96 includes ribs 104 extending outwardly therefrom into the plug reception cavity 98. The ribs 104 longitudinally extend over at least a portion of the base 96. Additionally, an opening 106 is formed within the base 96 that allows the inner shield 88 and engagement features of the outer shield 90 to pass into the plug reception cavity 98. Further, a contact channel (not shown) is formed in a rear wall (not shown) of the dielectric cover 84 that allows the central contact 86 to be slidably received and retained with the dielectric cover 84 through a longitudinal direction D. The central contact 86 is slid into the dielectric cover 84 through the rear end 103 of the dielectric cover 84. Alternatively, the central contact 86 may be inserted into the dielectric cover 84 through the opening 106 in the base 96 through a direction E or through an opening formed in the top wall 94.

The central contact 86 is similar to the central contact 40 described above. The central contact 86 includes a post 108 formed integrally with an intermediate portion 110. The post 108 is configured to be received and retained within a via or throughhole (not shown) formed in the circuit board 16. The intermediate portion 110 is joined with a right-angled transition portion 112, which is, in turn, joined with a clip portion 114. Alternatively, the central contact 86 may include a conductive pad, which electrically mates with a corresponding structure of the circuit board 16, instead of the post 108. The clip portion 114 includes a contact clip 116 that is configured to mate with a blade contact (not shown) of the plug housing 14. The central contact 86 may also include a barb 118, or other such protrusion, extending from an inner edge of the central contact 86. The barb 118 may securably engage a corresponding structure within the dielectric cover 84 upon assembly of the receptacle housing 82. The central contact 86 is a signal contact that forms a signal transmission line, in combination with the inner shield 42, and allows a signal to pass to and from the plug housing 14 through the receptacle housing 82 and into the circuit board 16. Similar to the central contact 40 discussed above, the central contact 86 is covered and shielded, yet electrically isolated and separated from, the inner shield 88, which is a ground member. The inner shield 88 is configured to partially surround the central contact 86.

The L-shaped inner shield 88 includes an upright leg 120, which is integrally formed with an extension arm 122. The extension arm 122 and the upright leg 120 form the L-shaped inner shield 88 and define a central contact chamber 123. The upright leg 120 includes posts 124 downwardly extending from support walls 127 at a mounting end 126, and a tab 128 outwardly extending from at least one support wall 127 proximate a cavity end 130. The tab 128 is configured to snapably, latchably, or otherwise securably engage a corresponding structure within the dielectric cover 84. The extension arm 122 outwardly extends from the upright leg 120 in a perpendicular fashion. The extension arm 122 includes side panels 132 formed integrally with a bottom panel 134. While the inner shield 42 shown in FIGS. 3-5 includes a top panel 58, the inner shield 88 includes a bottom panel 134 with an open top 136. Structures of the inner shield 88 that are similar to those of the inner shield 42 (for example, the posts 124 and the posts 64) function similarly.

The outer shield 90 includes side walls 138 formed integrally with a top wall 140 through beveled edges 142. The outer shield 90 also includes a partially open base 144 having tabs 146 and clamps 148 that securably engage corresponding structures of the dielectric cover 84. For example, the clamps 148 snapably engage the ribs 104 as the outer shield 90 is slid over the dielectric housing 84 in the direction of line D. Posts 150 extend downwardly from the base 144 and/or the side walls 138 and are received and retained within corresponding cavities within the circuit board 16. More or less posts 150 than those shown in FIG. 6 may be used with the outer shield 90. The outer shield 90 fits over the dielectric cover 84 and is an additional ground layer. Thus, the central contact 86 is shielded from the outside environment by a first ground layer, that is, the inner shield 88, a dielectric cover 84 that surrounds the inner shield 88, and a second ground layer, which is the outer shield 90 that surrounds the dielectric cover 84.

Figure 7:
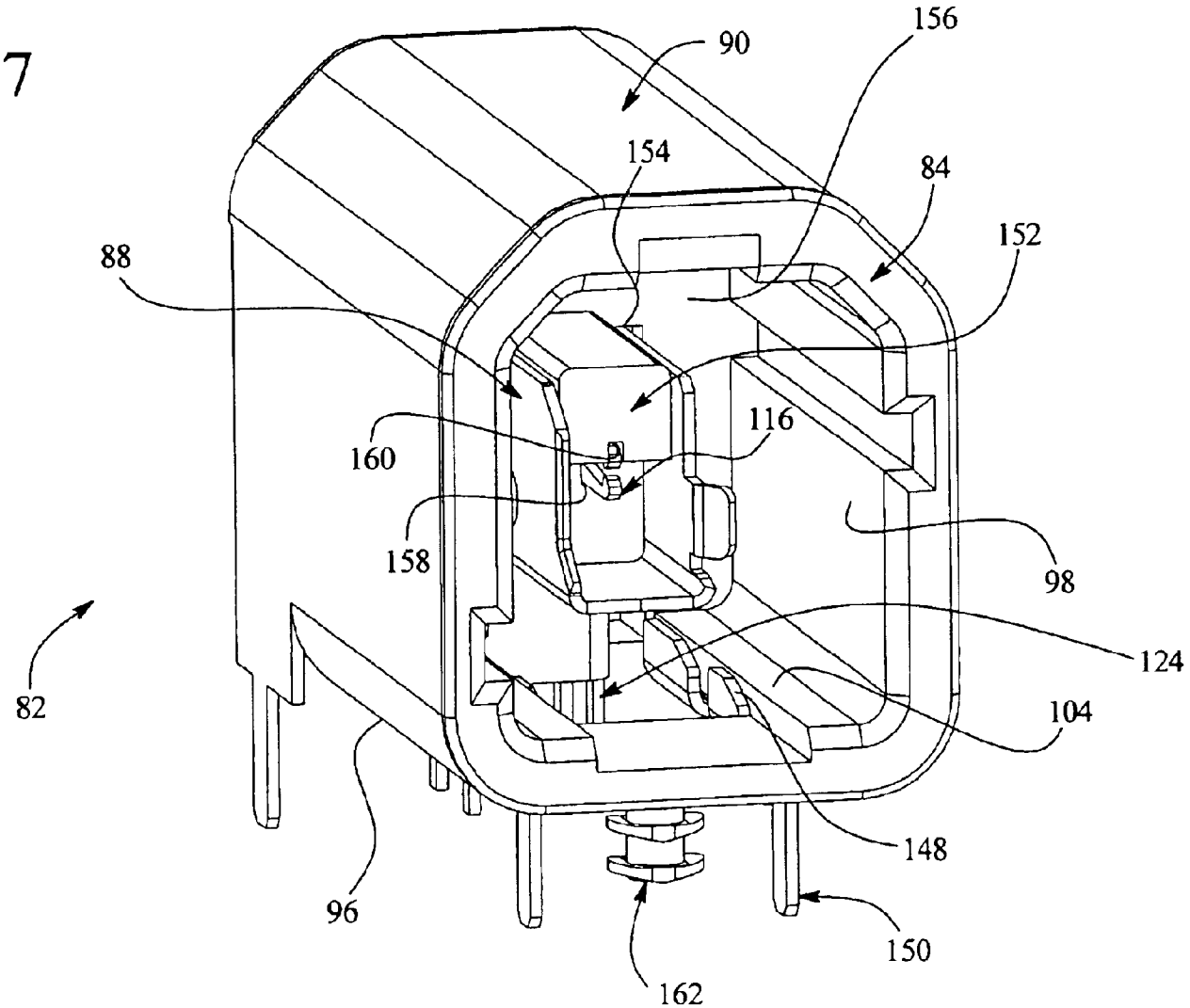
FIG. 7 illustrates an isometric front view of a receptacle housing according to an alternative embodiment of the present invention.

FIG. 7 illustrates an isometric front view of the receptacle housing 82 according to an alternative embodiment of the present invention. Similar to the receptacle housing 12, the receptacle housing 82 includes an integrally formed dielectric member 152 extending from a rear wall 156. The dielectric member 152 includes a contact channel 160 that allows the clip portion 114 to pass therethrough. Additionally, the rear wall 156 includes an inner shield channel 154 and a contact channel 158 formed in the rear wall 156 that allow the inner shield 88 and the central contact 86, respectively, to pass into the plug reception cavity 98. The dielectric cover 84 also includes a board lock member 162 extending downwardly from the base 96. The board lock member 162 may be integrally formed with the dielectric cover 84 and is configured to be received and retained by a corresponding locking cavity (not shown) formed in the circuit board 16. The board lock member 162 includes a central rod 166 integrally formed with coaxial collars 168. Various other board lock members may be used, such as those shown in FIGS. 9 and 10. Also, more or less than one board lock member 162 may be used with the receptacle housing 82 or the receptacle housing 12.

Figure 8:
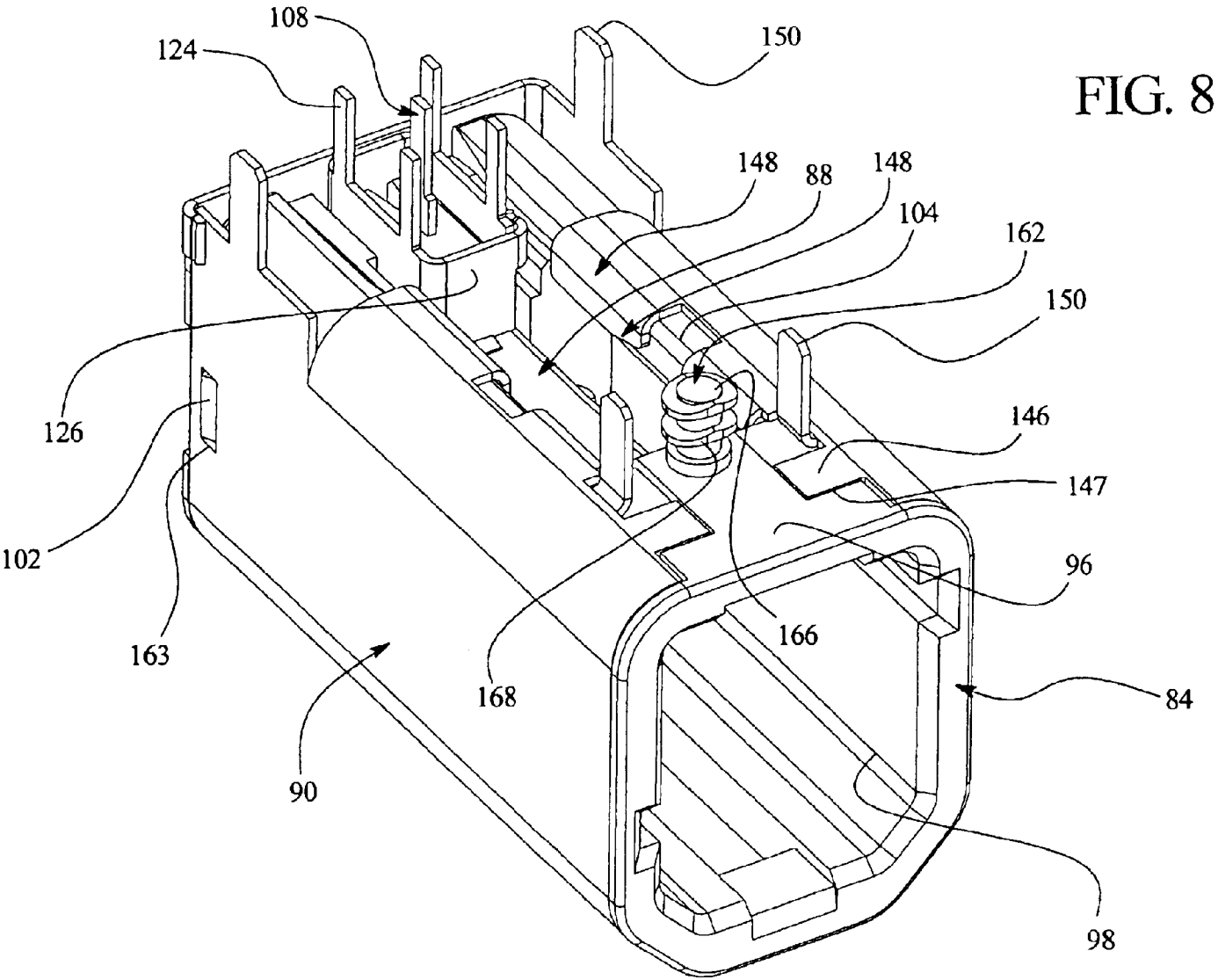
FIG. 8 illustrates an isometric bottom view of a receptacle housing according to an alternative embodiment of the present invention.

FIG. 8 illustrates an isometric bottom view of a receptacle housing 82 according to an alternative embodiment of the present invention. As discussed above, the clamps 148 of the outer shield snapably clamp or otherwise securably engage the ribs 104 of the dielectric cover 84. Similarly, the tabs 146 engage corresponding divots 147 formed in the base 96 of the dielectric cover 84. Additionally, the ramps 102 formed proximate the rear end 103 of the dielectric cover 84 snapably engage ramp-receiving members 163 formed proximate a rear edge of the outer shield 90.

Figure 9:
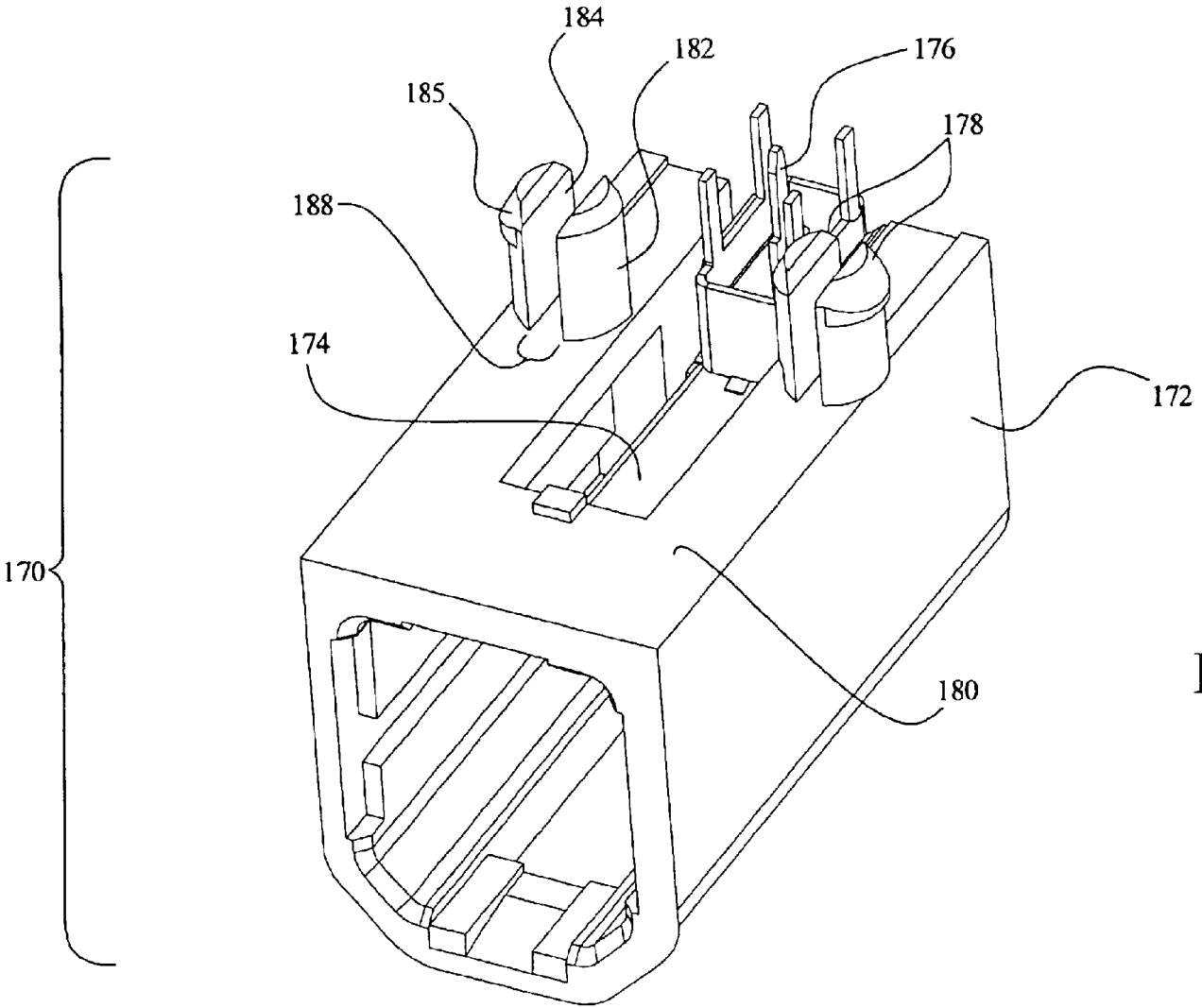
FIG. 9 illustrates an isometric bottom view of a receptacle housing according to an alternative embodiment of the present invention.

FIG. 9 illustrates an isometric bottom view of a receptacle housing 170 according to an alternative embodiment of the present invention. The receptacle housing 170 may be mated with the plug housing 14 and mounted on the circuit board 16. The receptacle housing 170 includes a dielectric cover 172, an inner shield 174, and a central contact 176. Additionally, two board locking members 178 extend outwardly from a base 180 of the dielectric cover 172. Alternatively, more or less board locking members 178 may be used than those shown in FIG. 9. The board locking members 178 may be integrally formed with the dielectric cover 172 or separately mounted thereon. The board locking member(s) 178 may be used with either the receptacle housing 12 or the receptacle housing 82. Each board locking member 178 includes a semi-cylindrical straight post 182 and a semi-cylindrical post 184 having a protrusion 185 extending outwardly from an outer terminal end. The straight post 182 and the post 184 are separated by a clearance gap 188.

Figure 10:
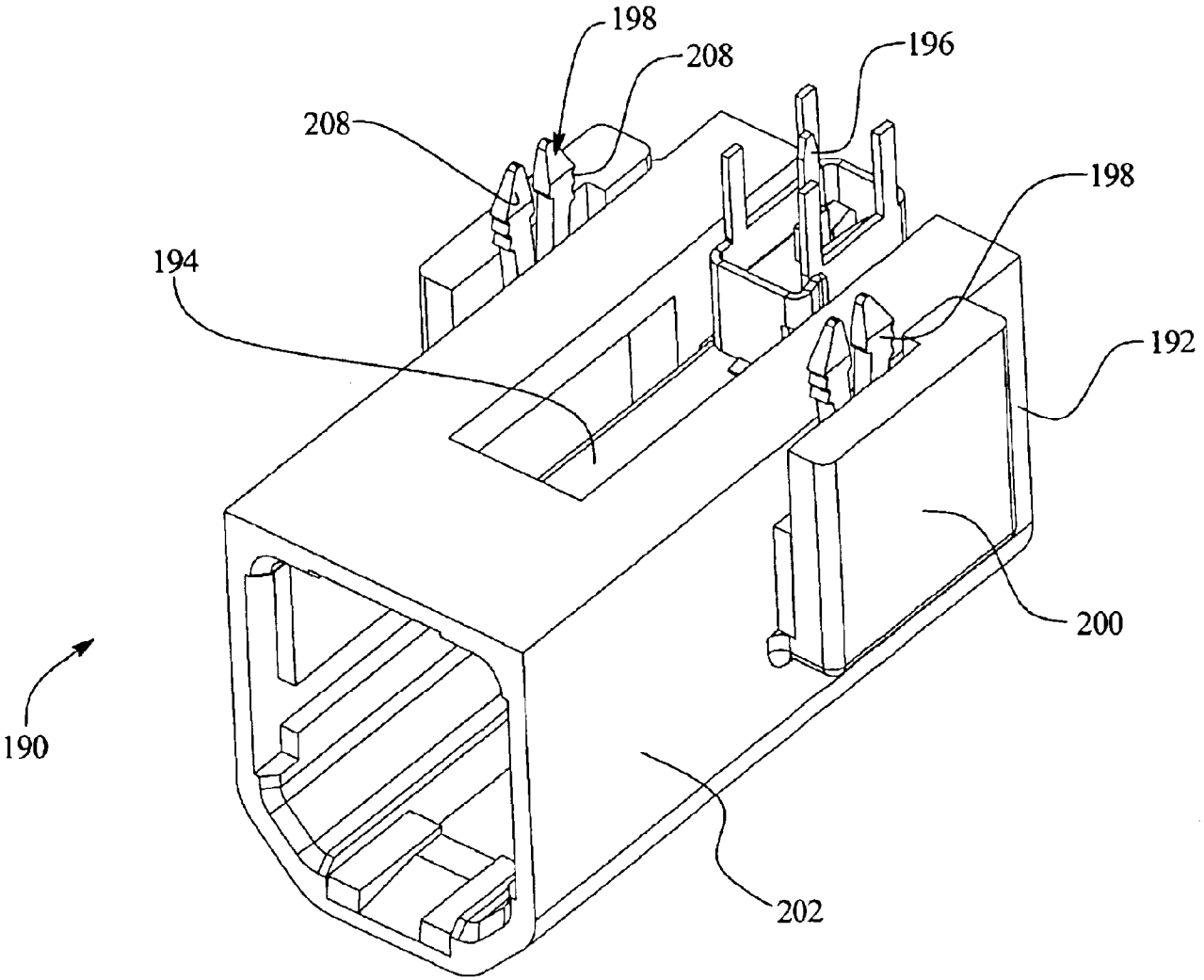
FIG. 10 illustrates an isometric bottom view of a receptacle housing according to an alternative embodiment of the present invention.

FIG. 10 illustrates an isometric bottom view of a receptacle housing 190 according to an alternative embodiment of the present invention. The receptacle housing 190 may be mated with the plug housing 14 and mounted on the circuit board 16. The receptacle housing 190 includes a dielectric cover 192, an inner shield 194, and a central contact 196. Additionally, two board locking members 198 extend outwardly from board lock mounts 200 integrally formed with side walls 202 of the dielectric cover 192. Alternatively, more or less board locking members 198 may be used than those shown in FIG. 10. The board locking members 198 may be integrally formed with the dielectric cover 192, or may be separately assembled into the board lock mount 200, either by direct insertion or insert molding. The board locking member(s) 198 may be used with any of the receptacle housing 12, the receptacle housing 170 or the receptacle housing 82. Each board locking member 198 may be a clip-type structure including two prongs 208 staked into the board lock housing 200.

As mentioned above, the electrical connector 10 is a right angle connector. That is, the mating surface of the circuit board 16 is perpendicular to the mating interface of the plug housing 14. The receptacle housing 12 includes a right angle central contact and a ground inner shield that allows the electrical signals to pass from the plug connector 14 to the circuit board 16.

The receptacle housings may be color coded to signify appropriate applications. For example, the dielectric covers may be colored to correspond to a variety of different applications. The dielectric covers may be made of different plastics having different dielectric constants. One plastic may be a first color while a second plastic may be a second color, and so on. One type of color-coded receptacle housing may be used with an RF transmission, while another may be used with a video system, and another may be used with an AM/FM stereo. An individual may quickly discern which type of receptacle housing to use based on the color of the dielectric cover.

Thus, embodiments of the present invention provide an electrical connector that is easy to assemble and economical in design. That is, the receptacle housing may be assembled from an integrally formed dielectric cover, an inner shield and a central contact. These components are not screw machined or die-cast, as are the majority of conventional RF receptacle housings. Embodiments of the present invention provide an electrical connector that utilizes an integrally formed, molded, one-piece dielectric cover and a stamped and formed center contact, inner shield and optional outer shield. Embodiments of the present invention may be used in strip line, square coaxial or various other configurations used in RF applications, among others.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. A connector assembly, comprising:

a central contact;

an inner ground shield surrounding at least a portion of said central contact; and a dielectric cover having an inner cavity receiving said central contact and said inner ground shield, said dielectric cover including a dielectric member formed integral therewith, said dielectric member extending into said inner cavity and having a channel formed therein and extending along a length of dielectric member to at least partially surround a top and both sides of said central contact to partially electrically isolate and separate said central contact and said inner ground shield from one another within said dielectric cover.

2. The connector assembly of claim 1, wherein said connector assembly conveys a coaxial radio frequency (RF) signal.

3. The connector assembly of claim 1, wherein said dielectric cover includes a rear wall closing a rear end of said inner cavity, said rear wall having said dielectric member formed thereon and projecting into said inner cavity, said channel extending from said rear wall into said inner cavity.

4. The connector assembly of claim 1, wherein said central contact and said inner ground shield are formed in a right angle configuration.

5. The connector assembly of claim 1, wherein said central contact and inner ground shield include pins configured to be mounted on a circuit board.

6. The connector assembly of claim 1, wherein said dielectric cover includes a rear wall having a passage therethrough, said passage permitting at least one of said inner ground shield and said central contact to be loaded therethrough into said inner cavity.

7. The connector assembly of claim 1, wherein at least one of said inner ground shield and said central contact are loaded into said dielectric cover through an opening formed in a base of said dielectric cover.

8. The connector assembly of claim 1, further comprising an outer ground shield securely mounted over said dielectric cover.

9. The connector assembly of claim 1, wherein said central contact comprises a clip portion extending perpendicularly from a leg, and wherein said inner ground shield is one of L-shaped, J-shaped and U-shaped and conforms to a contour of said central signal contact.

10. The connector assembly of claim 1, wherein said dielectric cover comprises a base having a board lock member extending outwardly therefrom, said board lock member being configured to retain said dielectric coyer on a circuit board.

11. A connector assembly comprising a first housing configured to be mounted to a coaxial cable and a second housing configured to be mounted on a circuit board, said first and second housings mating with one another, at least one of said first and second housings comprising:

a central contact;

a ground shield surrounding at least a portion of said central contact; and a dielectric cover holding said central contact and said ground shield, said dielectric cover comprising a contact cavity having an open front end and a closed rear wall, said rear wall comprising a dielectric member formed integral therewith and extending outwardly into said contact cavity, to a position between said central contact and said ground shield, said dielectric member member having a channel formed in and extending along a length of said dielectric member to at least partially surround a top and both sides of said central contact, wherein said central contact and said ground shield are partially electrically isolated and separated from one another within said dielectric cover by at least said dielectric member.

12. The connector assembly of claim 11, wherein said dielectric member extends along at least one complete side of said central contact.

13. The connector assembly of claim 11, wherein said dielectric member of one of said first and second housings is configured to slide along a corresponding dielectric member of the other of said first second housings.

14. The connector assembly of claim 11, wherein said ground shield includes bottom and side panels formed integrally with one another, wherein said bottom panel is positioned below said central contact and said dielectric member is positioned above said central contact.

15. The connector assembly of claim 11, wherein said ground shield includes top and side panels formed integrally with one another, wherein said top panel is positioned above said central contact and said dielectric member is positioned below said central contact.

16. The connector assembly of claim 11, wherein said connector assembly conveys a radio frequency (RF) signal.

17. The connector assembly of claim 11, wherein said dielectric cover includes a rear wall having a passage therethrough, said passage permitting at least one of said inner ground shield and said central contact to be loaded therethrough into said inner cavity.

18. The connector assembly of claim 11, further comprising an outer ground shield securely mounted over said dielectric cover.

19. The connector assembly of claim 11, wherein said dielectric cover comprises a base having a board lock member extending outwardly therefrom, said board lock member being configured to retain said dielectric cover on a circuit board.

* * * * *